US011472016B2

(12) United States Patent
Gisselman et al.

(10) Patent No.: US 11,472,016 B2
(45) Date of Patent: Oct. 18, 2022

(54) POWER TOOL

(71) Applicant: ATLAS COPCO INDUSTRIAL TECHNIQUE AB, Stockholm (SE)

(72) Inventors: Hans Niklas Gisselman, Vega (SE); Thomas Roger Bejefalk Thörn, Stockholm (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 165 days.

(21) Appl. No.: 17/057,714

(22) PCT Filed: Apr. 26, 2019

(86) PCT No.: PCT/EP2019/060782
§ 371 (c)(1),
(2) Date: Nov. 23, 2020

(87) PCT Pub. No.: WO2019/223954
PCT Pub. Date: Nov. 28, 2019

(65) Prior Publication Data

US 2021/0291342 A1 Sep. 23, 2021

(30) Foreign Application Priority Data

May 24, 2018 (SE) ..... 1830171-3

(51) Int. Cl.
*B25B 23/18* (2006.01)
*B25F 5/00* (2006.01)
(Continued)

(52) U.S. Cl.
CPC ..... *B25F 5/001* (2013.01); *B25F 3/00* (2013.01); *B25F 5/029* (2013.01); *F21V 33/0084* (2013.01); *F21Y 2115/10* (2016.08)

(58) Field of Classification Search
CPC .. B25B 23/18; B25F 3/00; B25F 5/029; B25F 5/001; F21V 33/0084; F21Y 2115/10
See application file for complete search history.

(56) References Cited

U.S. PATENT DOCUMENTS 6,814,461 B2 * 11/2004 Minalga ..... B25B 23/18 315/86
7,200,516 B1 * 4/2007 Cowley ..... B23B 49/00 356/138

(Continued)

FOREIGN PATENT DOCUMENTS

CN 106625452 A 5/2017
DE 102015218447 A1 6/2016

OTHER PUBLICATIONS

International Preliminary Report on Patentability (IPRP) dated Apr. 23, 2020 issued in International Application No. PCT/EP2019/060782.

(Continued)

*Primary Examiner* — Andrew M Tecco
(74) *Attorney, Agent, or Firm* — Holtz, Holtz & Volek PC

(57) ABSTRACT

A power tool is arranged to operate in at least a first operating mode and a second operating mode. The power tool is operative to provide a first type of light signal from a light emitting device arranged to light up an object to be processed when the power tool is set in the first operating mode and to provide a second type of light signal when the power tool is set in the second operating mode.

18 Claims, 1 Drawing Sheet

(51) Int. Cl.

| | |
|---|---|
| ***B25F 3/00*** | (2006.01) |
| ***B25F 5/02*** | (2006.01) |
| ***F21V 33/00*** | (2006.01) |
| *F21Y 115/10* | (2016.01) |

(56) References Cited

U.S. PATENT DOCUMENTS

| | | | | |
|---|---|---|---|---|
| 8,381,832 | B1 * | 2/2013 | Picard | B25B 21/00 30/500 |
| 9,028,088 | B2 * | 5/2015 | Vanko | B25F 5/00 362/120 |
| 9,644,837 | B2 * | 5/2017 | Vanko | B25B 21/00 |
| 9,923,249 | B2 * | 3/2018 | Rejman | H02J 7/0047 |
| 10,543,588 | B2 * | 1/2020 | Vanko | B25F 5/00 |
| 11,090,786 | B2 * | 8/2021 | Puzio | B25F 5/00 |
| 2003/0202851 | A1 | 10/2003 | Kovarik | |
| 2004/0174699 | A1 * | 9/2004 | Minalga | B25B 23/18 362/119 |
| 2014/0036482 | A1 * | 2/2014 | Vanko | B25F 5/021 362/119 |
| 2016/0172722 | A1 * | 6/2016 | Rejman | H02J 7/0047 429/7 |
| 2017/0106520 | A1 * | 4/2017 | Schadow | B25F 3/00 |
| 2022/0009064 | A1 * | 1/2022 | Puzio | H01F 38/14 |

OTHER PUBLICATIONS

International Search Report (ISR) dated Jul. 22, 2019 issued in International Application No. PCT/EP2019/060782.
Written Opinion dated Jul. 22, 2019 issued in International Application No. PCT/EP2019/060782.

* cited by examiner

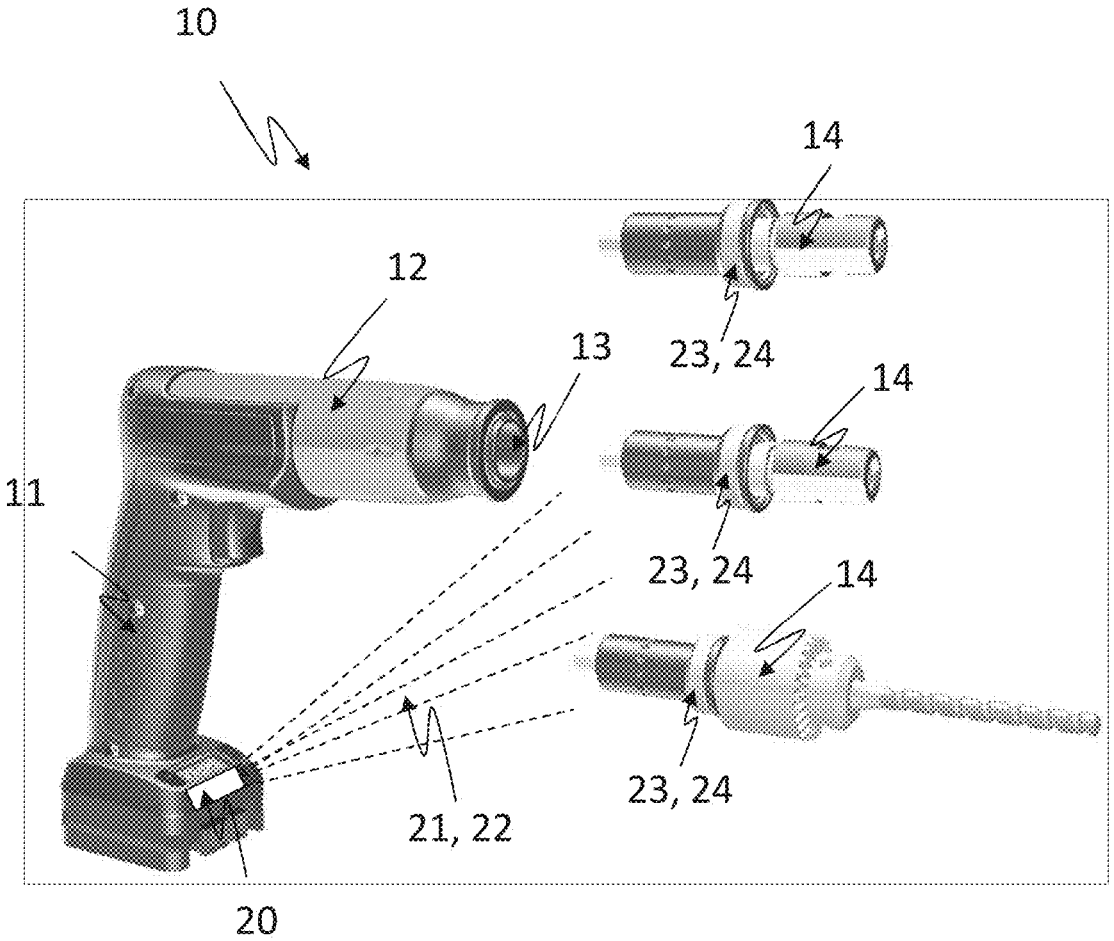
10
14
12
13
23, 24
14
11
23, 24
14
23, 24
21, 22
20

POWER TOOL

TECHNICAL FIELD

The invention relates to a power tool and a method in a power tool.

BACKGROUND

A problem concerned with prior art power tools is that the operator sometimes makes the mistake to choose the wrong operating mode suitable for a certain application. Thus the operator believe that he/she has chosen the correct operating mode, whereas in fact the wrong operating mode has been used to perform the operation. This could have a serious negative effect on the function and/or durability of the object or structure being processed by the power tool.

In order to avoid such problems prior art power tool systems can have some sort of display giving instruction to the operator. Or give training to the operator so that the operator learns which operating mode that should be used for different applications.

These methods are however not safe enough to ensure that the power tool is set in the correct operating mode.

There is therefore a need for an improved power tool that can solve or at least mitigate the above problems.

SUMMARY

It is an object of the present disclosure to ensure high quality of an object to be processed by providing a power tool which can ensure that the operator has chosen the correct operating mode for the object to be processed.

This object is achieved in accordance with a first aspect of the disclosure by a power tool arranged to operate in at least a first operating modes and a second operating mode. Whereby the power tool is operative to provide a first type of light signal from a light emitting device arranged to light up an object to be processed in case the power tool is set in the first operating mode and a second type of light signal in case the power tool is set in the second operating mode.

Accordingly, the object to be processed is clearly light up by a first type of light signal in case the power tool is set in the first operating mode and light up by a second type of light signal in case the power tool is set in the second operating mode. A correction of the operating mode can then be made, before the process is started, in case the power tool is set in the wrong operating mode.

In accordance with a second aspect, the present disclosure relates to a method in a power tool arranged to operate in at least a first operating modes and a second operating mode. Wherein the method comprises providing a first type of light signal from a light emitting device arranged to light up an object to be processed in case the power tool is set in the first operating mode and a second type of light signal in case the power tool is set in the second operating mode.

BRIEF DESCRIPTION OF THE DRAWINGS

FIG. 1 which shows a view of a power tool according an exemplary embodiment of the present invention.

DETAILED DESCRIPTION OF THE SHOWN EMBODIMENT

FIG. 1 illustrates a power tool 10 according to an exemplary embodiment of the present disclosure. The power tool

10 comprises a tubular housing part 12. The power tool 10 also comprises a handle 11. In one exemplary embodiment the handle 11 is substantially perpendicular to the tubular housing part 12. In other exemplary embodiments the handle 11 is line with the tubular housing part 12. An output cavity 13 is coaxially arranged within the tubular housing part 12. The output cavity 13 is arranged to detachably hold a detachable tool piece holder 14.

In this exemplary embodiment the power tool 10 is a cordless drill. Thus in this exemplary embodiment the power tool 10 is intended for drilling holes in different objects (not shown). The objects can be made of different materials. It is therefore important that the correct operating mode of the power tool 10 is chosen when drilling in different types of material. The power tool 10 is therefore arranged to operate in at least a first operating mode and a second operating mode. The power tool 10 further comprises a light emitting device 20 arranged to light up the object to be processed. In this exemplary embodiment the light emitting device 20 is arranged in the lower part of the handle of the power tool 10. An advantage with this position of the light emitting device 20 is that in case the operator also use the tubular housing part 12 as a handle, the light emitting device 20 is still able to light up the object to be processed.

The power tool 10 is operative to provide a first type of light signal 21 from a light emitting device 20 arranged to light up the object to be processed in case the power tool 10 is set in the first operating mode and a second type of light signal 22 in case the power tool 10 is set in the second operating mode.

By providing the first type of light signal 21 or the second type of light signal 22 based on which operating mode the power tool 10 is set in, the operator can easily see just by looking at the object which operating mode the power tool is set in. Thus it is easy for the operator to determine if the power tool 10 is set in the correct operating mode.

In one exemplary embodiment of the power tool 10 the first type of light signal 21 is a first color and the second type of light signal 22 is a second color. In a further exemplary embodiment of the power tool 10 the light emitting device 20 is a LED, Light Emitting Diode, arranged to emit both the first color and the second color. In another exemplary embodiment of the power tool 10 the first operating mode is first RPM, Revolutions per Minute, and the second operating mode is a second RPM.

In another exemplary embodiment of the power tool 10, the power tool 10 is further arranged to provide a third type of light signal in case the power tool fulfills yet another condition, such as e.g. being positioned perpendicular to the object to be processed and/or the power tool 10 applying the correct axial force on the object to be processed.

In another embodiment of the present disclosure the power tool 10 further comprises a from the power tool 10 detachable tool piece holder 14 comprising at least a first type of marking 23 or second type of marking 24 associated with the first or second type of light signals 21, 22.

An advantage with this embodiment is that the operator easily can see that the power tool 10 is set in the correct operating mode by comparing the first or second type of light signals 21, 22 with the first type of marking 23 or second type of marking 24.

In one exemplary embodiment of the power tool 10 the first type of marking 23 is a first color matching the first type of light signal 21 and the second type of marking 24 is a second color matching the second type of light signal 22.

The present disclosure also relates to a method, performed in the power tool 10 arranged to operate in at least a first operating modes and a second operating mode. In the method the power tool 10 provides a first type of light signal 21 from the light emitting device 20 arranged to light up the object to be processed in case the power tool is set in the first operating mode and a second type of light signal 22 in case the power tool is set in the second operating mode.

According to one exemplary embodiment of the method, the light emitting device 20 is arranged in the lower part of a handle 11 of the power tool 10.

According to another exemplary embodiment of the method, the first type of light signal 21 is a first color and the second type of light signal 22 is second color. According to yet another exemplary embodiment of the method, the power tool 10 further comprises a detachable tool piece holder 14, wherein the tool piece holder 14 comprising at least a first type of marking 23 or second type of marking 24 associated with the first type of light signal 21 or second type of light signal 22. In yet another exemplary embodiment of the method the light emitting device 20 is a LED, Light Emitting Diode, arranged to emit both the first color and the second color. In a further exemplary embodiment of the method the power tool 10 is a cordless drill. According to yet another exemplary embodiment of the method the first operating mode is a first RPM and the second operating mode is a second RPM.

The present disclosure also relates to a computer program which, when run in the power tool 10, causes the power tool 10 to perform the method as described above.

According to one exemplary embodiment, when the above-mentioned computer program code is run in a processor (not shown) of the power tool 10 it causes the power tool 10 to perform the method as described above.

The invention claimed is:

1. A power tool configured to operate in at least a first operating mode and a second operating mode, the power tool comprising:

a housing;

a detachable tool piece holder which is detachably attached to the housing;

a light emitting device arranged to emit light to an object to be processed; and a processor which is configured to control the light emitting device to provide a first type of light signal when the power tool is set in the first operating mode and to provide a second type of light signal when the power tool is set in the second operating mode, wherein the detachable tool piece holder comprises at least a first type of marking or second type of marking associated with the first type of light signal or second type of light signal.

2. The power tool according to claim 1, wherein the power tool includes a handle, and the light emitting device is arranged in a lower part of the handle.

3. The power tool according to claim 1, wherein the first type of light signal is a first color and the second type of light signal is a second color.

4. The power tool according to claim 3, wherein the light emitting device is a light emitting diode (LED) configured to emit both the first color and the second color.

5. The power tool according to claim 1, wherein the power tool is a cordless drill.

6. The power tool according to claim 1, wherein the first operating mode is a first revolutions per minute (RPM) and the second operating mode is a second RPM.

7. A method in a power tool that is configured to operate in at least a first operating mode and a second operating mode, the power tool including a light emitting device that is arranged emit light to an object to be processed, the method comprising:

providing a first type of light signal from the light emitting device in the first operating mode of the power tool, and providing a second type of light signal from the light emitting device in the second operating mode of the power tool, wherein the power tool comprises a detachable tool piece holder, and wherein the detachable tool piece holder comprises at least a first type of marking or second type of marking associated with the first type of light signal or second type of light signal.

8. The method according to claim 7, wherein the power tool includes a handle, and the light emitting device is arranged in a lower part of the handle.

9. The method according to claim 7, wherein the first type of light signal is a first color and the second type of light signal is a second color.

10. The method according to claim 9, wherein the light emitting device is a light emitting diode (LED) configured to emit both the first color and the second color.

11. The method according to claim 7, wherein the power tool is a cordless drill.

12. The method according to claim 7, wherein the first operating mode is a first revolutions per minute (RPM) and the second operating mode is a second RPM.

13. A non-transitory recording medium storing a computer program that is executable by a processor of a power tool that is configured to operate in at least a first operating mode and a second operating mode, the power tool including a light emitting device that is arranged emit light to an object to be processed, the power tool including the power tool a detachable tool piece holder, and the program being executable by the processor to control the power tool to perform functions comprising:

providing a first type of light signal from the light emitting device when the power tool is set in the first operating mode; and providing a second type of light signal from the light emitting device when the power tool is set in the second operating mode, wherein the detachable tool piece holder comprises at least a first type of marking or second type of marking associated with the first type of light signal or second type of light signal.

14. The non-transitory recording medium according to claim 13, wherein the power tool includes a handle, and the light emitting device is arranged in a lower part of the handle.

15. The non-transitory recording medium according to claim 13, wherein the first type of light signal is a first color and the second type of light signal is a second color.

16. The non-transitory recording medium according to claim 15, wherein the light emitting device is a light emitting diode (LED) configured to emit both the first color and the second color.

17. The non-transitory recording medium according to claim 13, wherein the power tool is a cordless drill.

18. The non-transitory recording medium according to claim 13, wherein the first operating mode is a first revolutions per minute (RPM) and the second operating mode is a second RPM.

* * * * *